US005206061A

United States Patent [19]

Ando et al.

[11] Patent Number: 5,206,061

[45] Date of Patent: Apr. 27, 1993

[54] DUST-PROOF HEADGEAR

[75] Inventors: Katsutoshi Ando, Otsu; Ryoichi Togashi, Shiga, both of Japan

[73] Assignee: Toray Industries, Inc., Tokyo, Japan

[21] Appl. No.: 640,432

[22] PCT Filed: May 26, 1989

[86] PCT No.: PCT/JP89/00532

§ 371 Date: Mar. 25, 1991

§ 102(e) Date: Mar. 25, 1991

[87] PCT Pub. No.: WO90/14024

PCT Pub. Date: Nov. 29, 1990

[51] Int. Cl.[5] ..... B32B 1/08

[52] U.S. Cl. ..... 428/34.7; 428/284; 428/286; 428/288; 428/297; 428/298; 428/903

[58] Field of Search ..... 428/903, 288, 284, 286, 428/297, 298, 34.7; 55/DIG. 39

[56] References Cited

U.S. PATENT DOCUMENTS 4,375,718 3/1988 Wadsworth et al. ..... 55/131
4,781,966 11/1988 Taylor ..... 428/288
4,909,975 3/1990 Sawyer et al. ..... 428/288
5,143,767 9/1992 Matsura et al. ..... 428/288

*Primary Examiner*—James J. Bell
*Attorney, Agent, or Firm*—Birch, Stewart, Kolasch & Birch

[57] ABSTRACT

A dust-proof headgear which, although having a simple construction, exhibits an excellent dust-proof performance to thereby remarkably reduce a scattering of hair, dandruff and dust from the wearer's head, while exhibiting a high air-permeability to thus eliminate any feeling of sultryness or stuffyness even when worn for a long time. The dust-proof headgear is made of a material having, as a major component thereof, an electret non-woven fabric having a surface electrostatic charge density of $1\times10^{-10}$ Coulomb/cm$^2$ or greater and an air-permeability of between 10 cc/cm$^2$.sec and 1000 cc/cm$^2$.sec. The headgear of the invention is highly effective for use in various fields of industry in which environmental contamination by contaminants from the heads of workers or habitants is strictly forbidden, e.g., the foodstuff industry, electronic industry, precision machining industry, and medical industry.

12 Claims, 2 Drawing Sheets

FIG. 1
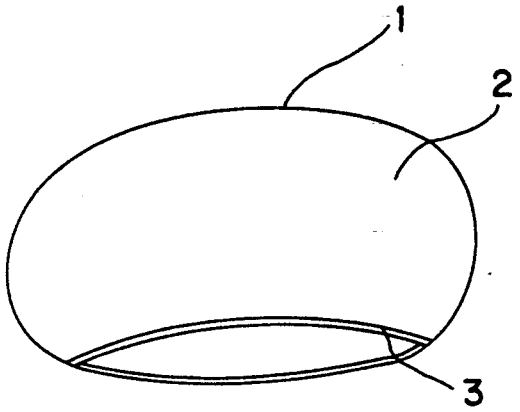
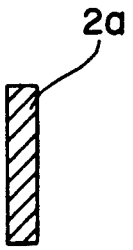
FIG. 2(A)
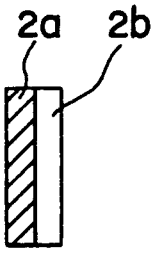
FIG. 2(B)
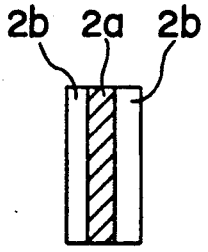
FIG. 2(C)

DUST-PROOF HEADGEAR

BACKGROUND OF THE INVENTION

1. Field of the Invention

The present invention relates to a dust-proof headgear having an extremely high dust-proof effect with a relatively simple construction and capable of producing a remarkable effect of a prevention of scattering of hair, dandruff and dust while allowing a high air permeability, to ensure that the wearer does not suffer from a feeling of overheating or stuffiness even after the headgear is worn for a long time. The headgear of the present invention can be effectively used in a variety of industrial fields which require such dust-proof headgear.

2. Description of Related Art

Hitherto, simple headgear, generally referred to as air caps or clean caps and made of a non-woven fabric having a high air permeability, have been used by workers working in environments which require a strict exclusion of dust, such as in the foodstuff industry, electronic industry, precision machining industry and pharmaceutical industry, as well as in the medical field.

The conventional headgear, however, undesirably allow hair, dandruff and dust to be scattered through the highly air-permeable non-woven fabric, with the result that the working environment, and the matters processed in such environments, are seriously contaminated.

Headgear made of a woven fabric having no air permeability, to completely block dust and other contaminants, are also known, but this headgear imparts an unpleasant feeling to the wearer because the wearer's head becomes hot or stuffy when such headgear is worn for a long time.

Therefore, it is common knowledge that air permeability and a dust-proof performance are generally incompatible in headgear of the kind described above.

SUMMARY OF THE INVENTION

Accordingly, an object of the present invention is to provide a dust-proof headgear having a high air-permeability enough to substantially avoid any feeling of heat or stuffiness even when worn or a long time, but exhibiting an excellent dust-proof performance.

Therefore, the present invention provides a headgear having the following features.

Namely, the dust-proof headgear of the present invention is made of a material having, as a major component thereof, an electret non-woven fabric having a surface electrostatic charge density not lower than $1 \times 10^{-10}$ Coulomb/cm$^2$ and an air-permeability of between 10 cc/cm$^2$. sec. and 1000 cc/cm$^2$.sec The headgear of the present invention has a relatively simple construction and exhibits an excellent air-permeability, and in addition, produces a remarkable dust-proof effect in that hair, dandruff, dust and so forth free in the headgear are effectively adsorbed and trapped by a multiplication of effects, i.e., an electrostatic adsorption effect possessed by the electret material and a mechanical filter effect of the same, thus preventing the captured contaminant from being scattered outside the headgear.

Therefore, the headgear of the present invention can be used without a feeling of sultryness, and without causing environmental contamination, and thus the headgear of the present invention has superior characteristics as a dust-proof headgear.

Accordingly, the headgear of the present invention is suitable for use in various working rooms, such as clean rooms, surgical operating rooms, pharmaceutical production rooms, kitchens of restaurants, food production factories, and working rooms of hygenic industries, electronic industries, precision machining industries and so forth, as well as environments where contamination by contaminants from the heads of workers or habitants must be strictly avoided.

The electret non-woven fabric used as the material of the headgear of the invention exhibits high dust-adsorption and trapping effects, even though having a high air-permeability and small weight per unit area. The electret non-woven fabric material used in the present invention preferably has a weight per unit area of 100 g/m$^2$ or less, more preferably 80 g/m$^2$ or less, most preferably several tens of g/cm$^2$, and thus the headgear of the invention has a very small total weight of between, for example, 10 g/m$^2$ and 50 g/m$^2$. Such an extremely light headgear does not impart an unpleasant feeling to the wearer. In addition, the headgear of the present invention may be used in a throw-away sense, because it can be produced at a low cost.

The headgear of the present invention, however, may be subjected to repeated use when the contamination is not serious, because it can be cleaned by washing with cold or hot water without substantially impairing the electret effect originally possessed by the headgear.

BRIEF DESCRIPTION OF THE DRAWINGS

FIG. 1 is a schematic perspective view of an embodiment of the headgear in accordance with the present invention;

FIGS. 2A to 2C are schematic sectional views illustrative of various examples of use of the electret material usable as the material of the headgear of the present invention.

DETAILED DESCRIPTION OF PREFERRED EMBODIMENTS

Figure 3:
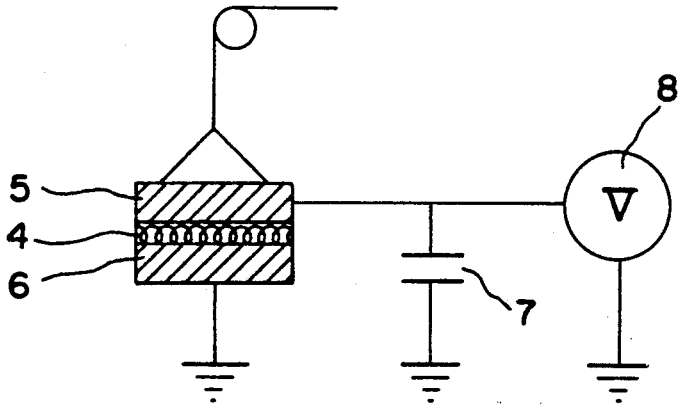
FIG. 3 is a schematic illustration of a measuring device, showing the method of measuring the surface electrostatic charge density.

The headgear of the present invention will be described in more detail with reference to the accompanying drawings.

FIG. 1 is a schematic perspective view of an embodiment of the dust-proof headgear of the present invention, constructed as a simple cap similar to that generally referred to as a hair cap or clean cap. The headgear 1 of the present invention is made mainly, at the least, from an electret non-woven fabric 2.

In the practical embodiment of the invention, the headgear is made from an electret material in the form of a non-woven fabric which is very light i.e., feather weight. Therefore, to prevent the headgear from slipping off the head when worn, preferably a suitable means such as a tightening string is provided to prevent the headgear from easily slipping off.

For example, the headgear shown in FIG. 1 is preferably provided with an elastic material around the headgear opening, or a suitable tightening means 3 such as a tightening string around the headgear opening. The elastic material or the tightening means is intended to prevent the headgear from easily slipping off, and may have various forms such as a cord, a snap-type fastener, a usual fastener, buttons and so forth. Any material having a substantial elasticity can be used as the elastic material. For example, the elastic material may be a rubber string. The tightening means also may be provided by sewing the edges of the brim of the headgear opening so as to form a continuous sack-like portion, and leading a string through the sack-like portion.

The electret non-woven fabric 2 may be used alone or in the form of a composite material or a laminate material in combination with another material or materials as shown in FIGS. 2, which are schematic sectional views showing various ways of using the electret non-woven fabric material usable as the material of the headgear of the present invention. FIG. 2A shows the case where the electret non-woven fabric material 2*a* is used alone, and FIGS. 2B and 2C show cases where the electret non-woven fabric 2*a* is used together with another material 2*b*, in the form of a composite material or a laminate material. As is obvious, the electret non-woven fabric may be used in forms other than those shown in FIGS. 2A to 2C.

The dust-proof headgear of the present invention can have various configurations, depending on the purpose or content of use thereof. For example, headgear with or without visors can be produced. The headgear also may be provided with openings in the regions on and around the wearer's ears.

The electret non-woven fabric material also can have a variety of forms. In general, however, the electret non-woven fabric is formed from long filaments or melt-blown fibers. Note, the electret non-woven fabric must have an air-permeability of 10 cc/cm$^2$ sec to 1000 cc/cm$^2$.sec. When the air-permeability is smaller than 10 cc/cm$^2$.sec, the headgear imparts a sultry or stuffy feeling and impairs the comfort of the headgear. On the other hand, an air-permeability of more than 1000 cc/cm$^2$.sec impairs the filtration effect, and thus undesirably allows a significant leakage of hair, dandruff and dust to the exterior of the headgear. When the electret non-woven fabric is used together with another material in the form of a composite or laminate material, such a composite or laminate material preferably exhibits an air-permeability within the above-specified range. When a light feather-weight electret melt-blown fibers fabric is used, the fabric preferably has an air permeability of between 10 cc/cm$^2$ sec and 400 cc/cm$^2$.sec, from the viewpoint of strength and tenacity. On the other hand, when the electret non-woven fabric is made from spun-bonded long fibers, a large air-permeability of 300 to 1000 cc/cm$^2$.sec is acceptable because such a non-woven fabric exhibits a high strength and tenacity.

The present inventors have found that the surface electrostatic charge density of the electret non-woven fabric is preferably $1\times10^{-10}$ Coulomb/cm$^2$ or greater, to effectively prevent a scattering of contaminants such as hair, dandruff and dust from the headgear, by making use of the electrostatic adsorption, and considering the wearer's activity during working.

Preferably, the electret non-woven fabric is composed of organic synthetic materials having a volume resistivity of $10^{14}$ Ω.cm or greater. For example, the electret non-woven fabric can be formed from polypropylene fibers. The non-woven fabric is preferably formed by a spun-bonded method, melt-blown method or burst-fiber method. To obtain an appreciable dust trapping effect, the mean fineness or size of the fibers constituting the non-woven fabric is preferably 10 denier or less, more preferably 3 denier or less. In particular, the melt-blown non-woven fabric formed from polypropylene fibers is preferably used, partly because it can easily reduce the mean fineness to 0.5 denier or less and even to 0.1 denier or less, and partly because it can provide a high strength. It is understood that a higher degree of mean fineness is preferred because it enables the number of fibers to be increased, to thereby enhance the dust trapping and adsorption effects. The invention does not pose any restriction with regard to the lower limit of the mean fineness but a mean fineness of less than 0.001 denier is impractical in view of the present level of technology. Of course, future developments in technology will enable the production of finer fibers, and such finer fibers also may be able to be used as the material of the headgear of the present invention.

When spun-bonded non-woven fabrics are used, the mean fineness of fibers is generally 10 denier or less, and thus the fiber size is generally greater than that of the above-mentioned melt-blown fibers. The use of spun-bonded non-woven fabrics having a cross-sectional flatness of 1.2 or greater is preferable because such fibers enhance the effect of adsorbing and trapping hairs. This is attributable to two factors: an enhancement of the adsorption due to an increase in the area of contact between the fibers and the hairs, and an enhancement of the adsorption due to an increased surface electrostatic charge density. The term "cross-sectional flatness" is used to mean a value obtained by measuring the lengths of longer and shorter axes of the cross-section of the fiber and dividing the longer-axis length by the shorter-axis length. In the present invention, the flatness is expressed in terms of a mean value of flatness in number n of fibers; in this case, values n being 50.

According to the present invention, the weight of the electret non-woven fabric is preferably 100 g/m$^2$ or less, more preferably between 10 g/m$^2$ and 50 g/m$^2$. When the weight is within the above-specified range, it is possible to produce a dust-proof headgear which is extremely light and soft, to thus avoid any discomfort or fatigue when wearing the headgear.

When the electret non-woven fabric is used together with another material, i.e., as a composite or laminate material, the material combined with the electret non-woven fabric material is preferably a different non-woven fabric having a high level of tenacity. Also, preferably the material combined with the electret non-woven fabric has a high surface smoothness and does not exhibit scuffing and dust-generation. Accordingly, most preferably long-fiber non-woven fabrics, in particular spun-bond long fiber non-woven fabrics, are used although non-woven fabrics of short fibers are satisfactory. The material combined with the electret non-woven fabric material may be slightly electretified, to ensure that the composite material has high electret characteristics, but this is not essential. In practice, the material to be combined with the electret non-woven fabric should be selected with a view to adding properties which are not possessed by the electret non-woven fabric, which is the main component. For example, a material having a high tenacity, a material having an anti-electrostatic characteristic, a material which improves the appearance, and so forth are suitable for use as the material to be combined with the electret non-woven fabric.

In particular, when a plurality of kinds of electret non-woven fabric are used in the form of a composite or laminate material, a combination of an electret non-woven fabric of melt-blown fibers and an electret non-woven fabric of spun-bonded long fibers, in the form of a composite or laminate material, provides a high practical utility because such a combination exhibits both a high dust trapping effect and a high tenacity. In the use of such a composite or laminate material, the best results are obtained when both electret non-woven fabric materials have a surface electrostatic charge density of $1\times10^{-10}$ Coulomb/cm$^2$ or greater and an air permeability of between 10 cc/cm$^2$.sec and 1000 cc/cm$^2$.sec. This, however, is not essential, and an appreciable effect is obtained if the above-specified surface electrostatic charge density and the air-permeability requirements are met by one of the electret non-woven fabric.

Accordingly, the dust-proof headgear of the present invention is made of a material having at least an electret non-woven fabric as the major component thereof, and the invention does not exclude the use of a different material or materials in addition to the electret non-woven fabric, which is the major component, at desired locations on the headgear.

It also will be clear that the dust-proof headgear of the present invention may have been subjected to various treatments or processes, such as printing, coloring and so forth, before use.

Nevertheless, considering that the headgear of the present invention is expected to be used in fields where the hygenic condition or an attractive appearance are significant factors, the headgear preferably has a simple design and is white or another light color.

For example, when the headgear is intended for use in a throw-away sense, i.e., for disposal after use for 1 week to 10 days, the electret non-woven fabric material preferably is white or another light color, from the viewpoints of practicality, cost and hygienic appearance.

The headgear of the present invention, when slightly contaminated, can be repeatedly used by washing with cold or hot water, without impairing the electret characteristics thereof.

A description will be given of a method of measuring the surface electrostatic charge density, with specific reference to FIG. 3.

A material 4 to be measured, i.e., an electret non-woven fabric material, is set between a grounded electrode 5 and another metallic electrode 6, 4 cm in diameter, and electrostatic charges are induced and accumulated in a capacitor 7. Then, the voltage across the capacitor 7 is measured with a voltmeter 8 and the surface electrostatic charge density is determined in accordance with the following formula. In FIG. 3, reference numeral 9 denotes the ground.

$$\text{Surface electrostatic charge density (Coulomb/cm}^2) = C\times V/S$$

where,

C: capacitance of capacitor (farad)

V: voltage (volt)

S: area of electrode (cm$^2$)

The air-permeability of the electret non-woven fabric is measured by using a fragile-type testing machine in accordance with the testing method as specified by JIS L-1096.

Examples of the headgear in accordance with the present invention, in particular practical constructions and performances, will be described hereinafter.

EXAMPLE 1

A melt-blown fiber non-woven fabric made of polypropylene fibers having a mean fineness of 0.03 denier (d) was prepared and electretified in an electric field produced by a high voltage.

The thus obtained electret non-woven fabric had a surface electrostatic charge density of $5\times10^{-10}$ Coulomb/cm$^2$, a weight of 20 g/m$^2$, and an air-permeability of 80 cc/cm$^2$ sec.

Using this electret non-woven fabric, a dust-proof headgear of the hair cap type, as schematically shown in FIG. 1, was fabricated. A flat rubber string as an elastic material was attached to the open brim of the headgear, to obtain a tight fit of the headgear to the wearer's head, to prevent the headgear from easily slipping off the head, and to prevent a leakage of dust and other contaminants.

The thus fabricated headgear was subjected to test use in a clean room, and it was found that the headgear could be used without a feeling of sultryness or stuffyness, and without causing fatigue or discomfort. The headgear of this Example remarkably reduced the scattering of dust and other matter from the wearer's head, and thus it was confirmed that the headgear of this Example is an excellent product which is usable without substantially causing contamination.

EXAMPLE 2

Two types of electret non-woven fabric materials were prepared; a polypropylene melt-blown fiber non-woven fabric having a mean fineness of 0.05 d and a weight of 20 g/m$^2$, and a polypropylene spun-bonded long-fiber non-woven fabric having a mean fineness of 2*d* and a weight of 15 g/m$^2$. These two electret non-woven fabrics were bonded together by a heat-emboss bonding method, to form a composite fabric material. The thus obtained composite fabric material was then electretified in an intense electric field, whereby an electret non-woven fabric having a surface electrostatic charge density of $3\times10^{-10}$ Coulomb/cm$^2$ was obtained.

The thus obtained electret non-woven fabric was formed into a dust-proof head gear of the type schematically shown in FIG. 1, such that the melt-blown fiber non-woven fabric was in contact with the wearer's head. The air-permeability of this electret material was 75 cc/cm$^2$.sec.

As in Example 1, a rubber string as an elastic material was provided around the open brim of the headgear, to ensure a tight fit of the headgear to the user's head while preventing a leakage of dust and other contaminants.

A test use of this dust-proof headgear in a clean room showed that the headgear is usable without imparting a feeling of sultryness, while reducing a scattering of dust and other contaminants from the wearer's head compared with conventional similar products. Thus, it was confirmed that the headgear is usable without substantially causing environmental contamination. It was also confirmed that the headgear had a superior durability and could withstand long term use.

EXAMPLE 3

A melt-blown fiber non-woven fabric was prepared from polypropylene fibers having a mean fineness of 0.03*d* and a weight of 50 g/m$^2$, and was electretified in an intense electric field, whereby an electret non-woven fabric having a surface electrostatic charge density of $5.5\times10^{-10}$ was obtained.

Also prepared was a polyester spun-bonded long-fiber non-woven fabric having a mean fineness of *2d* and a weight of 20 g/m$^2$, which had undergone an anti-electrostatic treatment. The above-mentioned electret non-woven fabric material and the polyester spun-bonded long-fiber non-woven fabric were heat-bonded together to form a composite fabric. The polyester spun-bonded long-fiber non-woven fabric was not electretified materially. The composite fabric thus formed had an air-permeability of 40 cc/cm$^2$.sec.

The thus obtained composite fabric was formed into a headgear such that the melt-blown fiber non-woven fabric was in contact with the wearer's head. The edge of the opening of the headgear was sewn to form a continuous sack-like portion through which a tightening string was led, to enable the headgear to be tightly fitted on the wearer's head while avoiding a leakage of dust.

This headgear could be used satisfactorily without a feeling of sultryness. It was also confirmed that this headgear was usable without substantially causing environmental contamination.

EXAMPLE 4

The headgear of the invention was fabricated from a polypropylene spun-bonded long-fiber non-woven fabric having a mean fineness of *2d*, a weight of 20 g/m$^2$, air-permeability of 400 cc/cm$^2$.sec, and a surface electrostatic charge density of $1.5\times10^{-10}$ Coulomb/cm$^2$.

Then 50 pieces of the headgear were subjected to test use by 50 workers engaged in foodstuff production, and it was found that a dropping and scattering of hair was almost completely prevented.

Almost all of the workers involved in the test of the headgear stated that the headgear could be used comfortably without a feeling of sultryness or stuffyness.

EXAMPLE 5

A polypropylene spun-bonded long-fiber non-woven fabric was prepared to a mean fineness of *2d*, a weight of 20 g/m$^2$, an air-permeability of 400 cc/cm$^2$ sec, and a surface electrostatic charge density of $1.5\times10^{-10}$ Coulomb/cm$^2$. The thus prepared non-woven fabric was then subjected to a calendering treatment, whereby a non-woven fabric having an air-permeability of 150 cc/cm$^2$.sec and composed of flat fibers having a cross-sectional flatness of 1.6 was obtained.

This non-woven fabric was electretified so that an electret non-woven fabric sheet having a surface electrostatic charge density of $1.5\times10^{-9}$ Coulomb/cm$^2$ was obtained.

Using this electret non-woven fabric sheet, a dust-proof headgear of the hair cap type, as schematically shown in FIG. 1, was fabricated. The headgear thus fabricated was subjected to test use in a clean room, and it was found that the headgear could be used without a feeling of sultryness or stuffyness, and without causing fatigue or discomfort. The headgear of this Example also remarkably reduced the scattering of dust and other matter from the wearer's head, and thus it was confirmed that the headgear of this Example could be suitably used as dust-proof headgear in a clean room. It was also confirmed that this headgear had an excellent durability.

We claim:

1. A dust-proof headgear made from a material having, as a major component thereof, an electret non-woven fabric having a surface electrostatic charge density of $1\times10^{-10}$ Coulomb/cm$^2$ or greater and an air-permeability of between 10 cc/cm$^2$.sec and 1000 cc/cm$^2$ sec.

2. A dust-proof headgear according to claim 1, wherein said electret non-woven fabric is made from melt-blown fibers having a mean fineness of 0.5 denier or finer.

3. A dust-proof headgear according to claim 2, wherein said electret non-woven fabric is a melt-blown fiber non-woven fabric made of polypropylene fibers having a mean fineness of 0.1 denier or finer.

4. A dust-proof headgear according to claim 1, wherein said electret non-woven fabric material is a spun-bonded long-fiber non-woven fabric having a mean fineness of fibers of 10 denier or finer.

5. A dust-proof headgear according to claim 4, wherein said electret non-woven fabric is a spun-bonded long-fiber non-woven fabric composed of fibers having a cross-sectional flatness not smaller than 1.2.

6. A dust-proof headgear according to claim 1, wherein the weight of said electret non-woven fabric is not greater than 50 g/m$^2$.

7. A dust-proof headgear according to claim 1, wherein said electret non-woven fabric is combined with other materials to thereby form a composite or laminate material.

8. A dust-proof head gear according to claim 1, wherein said electret non-woven fabric is a composite or laminate material having an electret melt-blown non-woven fabric and an electret spun-bonded long-fiber non-woven fabric.

9. A dust-proof headgear according to claim 1, 2, 3, 4, 5, 6, 7 or 8, wherein a substantially elastic material or a tightening member is provided around the opening of said headgear.

10. A dust-proof headgear according to claim 9, wherein said elastic material is a string or a belt-like member of rubber.

11. A dust-proof headgear according to claim 9, wherein said tightening member is a string-like member.

12. A dust-proof headgear according to claim 1, wherein said electret non-woven fabric has a substantially white color.

* * * * *